US009931847B2

(12) United States Patent
Wagner et al.

(10) Patent No.: US 9,931,847 B2
(45) Date of Patent: Apr. 3, 2018

(54) SERVICING A PRINTHEAD OF A PRINTER

(71) Applicant: HEWLETT-PACKARD DEVELOPMENT COMPANY, L.P., Houston, TX (US)

(72) Inventors: Jeffrey Allen Wagner, Vancouver, WA (US); Thomas M Sabo, San Diego, CA (US); Ronald A Askeland, San Diego, CA (US); Gonzalo Gaston Llado, Barcelona (ES); Alyssa Michelle Siegman, San Diego, CA (US); Lawrence H White, Corvallis, OR (US); Alex Andrea Tallada, Barcelona (ES); Brian J Keefe, La Jolla, CA (US); Maria Magdalena Martinez Ferrandiz, San Cugat del Valles (ES); Daniel Vincent Keane, San Diego, CA (US); Yi Hong Tor, San Diego, CA (US); Marian Dinares Argemi, Terrassa (ES); Francisco Lopez Moral, Castellbisbal (ES); Xavier Bruch, San Cugat del Valles (ES); Chandrasekhar Nadimpalli, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/500,638

(22) PCT Filed: Jul. 31, 2014

(86) PCT No.: PCT/US2014/049116
§ 371 (c)(1),
(2) Date: Jan. 31, 2017

(87) PCT Pub. No.: WO2016/018357
PCT Pub. Date: Feb. 4, 2016

(65) Prior Publication Data
US 2017/0217189 A1 Aug. 3, 2017

(51) Int. Cl.
*B41J 2/165* (2006.01)
*B41J 2/175* (2006.01)
(Continued)

(52) U.S. Cl.
CPC ..... *B41J 2/16508* (2013.01); *B41J 2/165* (2013.01); *B41J 2/16517* (2013.01); *B41J 2/175* (2013.01);
(Continued)

(58) Field of Classification Search
CPC . B41J 2/04508; B41J 2/175; B41J 2/96; B41J 2/165; B41J 2/16505; B41J 2/16508;
(Continued)

(56) References Cited

U.S. PATENT DOCUMENTS 6,505,911 B1 1/2003 Hwang
6,554,392 B2 * 4/2003 Vega ..... B41J 2/16508 347/23
(Continued)

FOREIGN PATENT DOCUMENTS

WO WO2013/095497 6/2013

OTHER PUBLICATIONS

"TechNotable: Automatic Nozzle Performance Testing", Hewlett-Packard Development Company, L.P., Jul. 2006.

*Primary Examiner* — Anh T. N. Vo
(74) *Attorney, Agent, or Firm* — HP Inc. Patent Department

(57) ABSTRACT

A printer is disclosed herein. The printer has a printhead having a plurality of ink nozzles for ejecting ink, a servicing mechanism for capturing the ejected ink from the ink nozzles, to service the printhead, and a control device coupled to the printhead and the servicing mechanism for regulating the servicing. As part of the regulation, the control device continues feeding a substrate towards the
(Continued)

printhead during an idle period. The idle period of the printhead can be a duration when printing on the substrate is suspended. Further, the control device regulates ejection of ink from the ink nozzles towards the substrate during the idle period and operates the servicing mechanism during the idle period. In an example, the servicing mechanism captures the ink before the ink reaches the substrate.

15 Claims, 5 Drawing Sheets

(51) Int. Cl.

| | |
|---|---|
| ***B41J 2/17*** | (2006.01) |
| *B41J 2/045* | (2006.01) |
| *B41J 29/393* | (2006.01) |
| *B41J 29/38* | (2006.01) |

(52) U.S. Cl.
CPC ..... *B41J 2/1707* (2013.01); *B41J 2/1714* (2013.01); *B41J 2/04508* (2013.01); *B41J 2/16505* (2013.01); *B41J 2/16526* (2013.01); *B41J 2/17596* (2013.01); *B41J 29/38* (2013.01); *B41J 29/393* (2013.01)

(58) Field of Classification Search
CPC .. B41J 2/16517; B41J 2/16526; B41J 2/1707; B41J 2/1714; B41J 29/38; B41J 2/393
See application file for complete search history.

(56) References Cited

U.S. PATENT DOCUMENTS

| | | | | |
|---|---|---|---|---|
| 6,783,209 | B2 * | 8/2004 | Gompertz | B41J 2/165 347/14 |
| 8,087,746 | B2 | 1/2012 | Ray | |
| 8,485,635 | B2 | 7/2013 | Stadler | |
| 8,544,983 | B2 * | 10/2013 | Tanaka | B41J 2/16508 347/29 |
| 9,427,970 | B2 * | 8/2016 | Cessel | B41J 2/15 |
| 2007/0002088 | A1 | 1/2007 | Jeong | |
| 2007/0046702 | A1 | 3/2007 | Beak et al. | |

* cited by examiner

SERVICING A PRINTHEAD OF A PRINTER

BACKGROUND

Printers, such as inkjet printers, find a variety of applications owing to low cost, high speed, and high quality of printing. An inkjet printer includes a printhead having a plurality of ink nozzles for precisely delivering small volumes of ink on to a substrate for printing on the substrate by a non-impact process. The ink employed in such printers is usually a water-based ink or an aqueous ink prone to drying if the printer is unused for long durations. Accordingly, measures are usually taken in such printers to prevent the ink from drying up.

BRIEF DESCRIPTION OF FIGURES

The detailed description is provided with reference to the accompanying figures. In the figures, the left-most digit(s) of a reference number identifies the figure in which the reference number first appears. The same numbers are used throughout the figures to reference like features and components.

DETAILED DESCRIPTION

Figure 1:
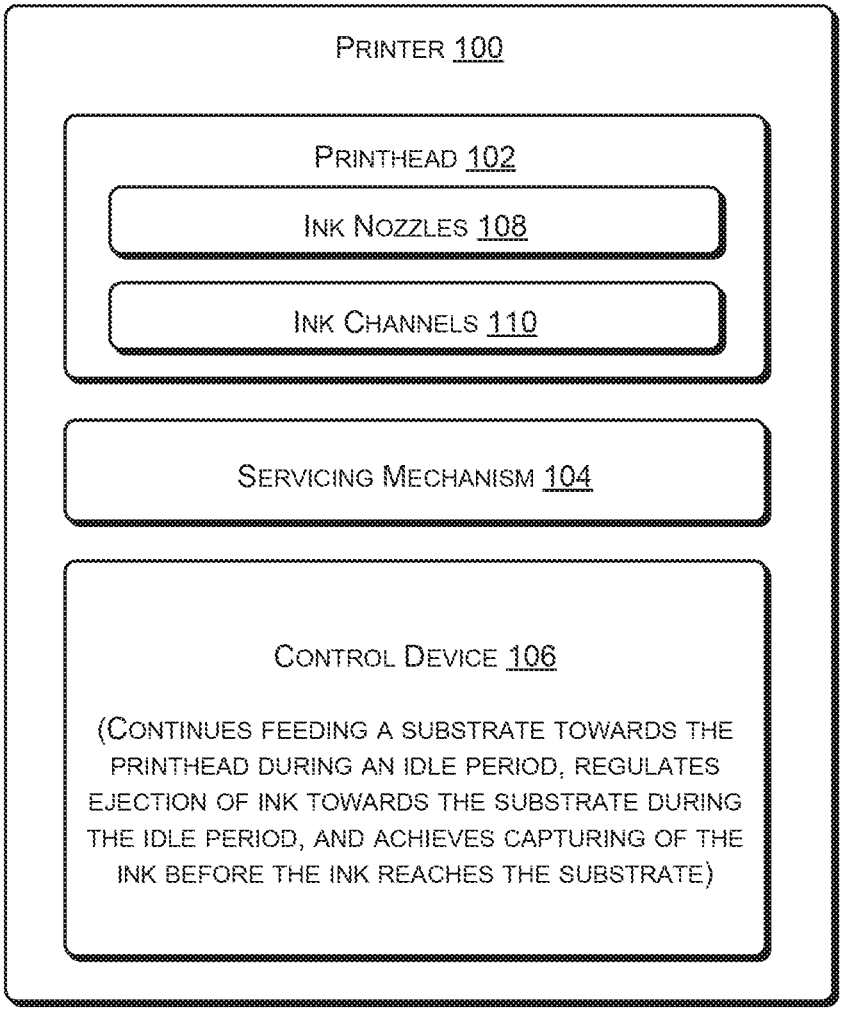
FIG. 1 illustrates a schematic of a printer, according to an example of the present subject matter.

Generally, all ink nozzles of a printhead of a printer may not function continuously, depending on type of print, colors to be used, and the area of a substrate on which the printing is to be achieved. In such a case, ink, such as a water-based ink, in non-functioning ink nozzles may lose water and may form a viscous mix of non-aqueous components of the ink. The drying of ink may block the ink nozzles which when used for printing, may not eject ink, or if it does, ejects the viscous mix onto the substrate, adversely affecting quality of prints. Accordingly, regular servicing and maintenance of the printhead is done in order to prevent the ink nozzles from being blocked due to drying of ink. Generally, for servicing the printhead, a servicing assembly is provided on the printer. The servicing assembly can have a spittoon movable with respect to the printhead. All or at least the non-functioning ink nozzles of the printhead are controlled to eject the ink into the spittoon to prevent drying of the ink and accumulation of the dried components in the ink nozzle. However, for servicing the printer using the above mentioned servicing assembly, feed of the substrate towards the printhead is stalled which may result in substantial downtime of the printer. Consequently, the productivity of the printer is substantially low.

Systems and methods for servicing a printhead of a printer are described herein. The present subject matter provides an approach for servicing the printhead without ceasing operation of the printer, i.e., without affecting feed of the substrate toward the printhead. For example, in case of a page wide array printer, the feed of the substrate towards the printhead can be continued. At the same time, ink nozzles in the printhead are made to eject ink which is captured before it reaches the substrate. Therefore, the printer experiences considerably less, for instance, almost negligible, downtime in the servicing achieved in accordance with the present subject matter.

For the purpose of servicing the printhead, the printer includes a servicing mechanism. In an example, the servicing mechanism can capture the ejected ink from the plurality of ink nozzles during servicing. The operation of the servicing unit and the printhead are regulated for achieving the servicing of the printhead. As mentioned above, feed of the substrate towards the printhead is unaffected during an idle period. The idle period of the printhead can be a duration when printing on the substrate is suspended. Further, ejection of ink from the plurality of ink nozzles towards the substrate is controlled during the idle period. Subsequently, the servicing mechanism is operated during the idle period to capture the ink before the ink reaches the substrate.

In an example of the present subject matter, the servicing mechanism can include a spittoon which is movable with respect to the printhead, between the printhead and the substrate, for capturing the ink. The movement of the spittoon can be regulated during the idle period, when the feed of the substrate toward the printhead is unaffected and the ink from the printhead is ejected. For instance, the ejection of the ink can be achieved at the same velocity as that during the printing operation. Accordingly, the spittoon prevents the ink from reaching the substrate during the idle period. In an example, the spittoon can be provided with an absorbent for effectively capturing the ink.

In an example, the idle period can correspond to a non-printable portion of the substrate. The non-printable portion, as the name suggests, refers to that portion of the substrate on which printing is not to be achieved. Accordingly, in said example, the spittoon can be moved along the printhead for servicing and capturing ink when the non-printable portion of the substrate is passing across the printhead. In another example, the idle period can be a turnaround period of the printhead at an end of swath. In the latter case, the printhead can be a scanning type printhead.

In an example, the spittoon can be movable along a width of a nozzle plate of the printhead. In other words, the spittoon can be movable along a short dimension of the nozzle plate of the printhead. The nozzle plate can be the part of the printhead having the plurality of ink nozzles provided thereon. Accordingly, the spittoon can move across the printhead and capture the ink in considerably less time. For instance, in such a case, the spittoon can easily achieve the servicing of the printhead during the idle period corresponding to the non-printable portion of the substrate.

In another example, the servicing mechanism can include an air blower provided in proximity of the ink nozzles to blow away the ink ejected from the ink nozzles during the idle period, and a blower-spittoon provided in proximity of the air blower and the ink nozzles to capture the ink blown by the air blower.

Further, in said example, to effectively achieve the capturing of the ink without allowing the ink to reach the substrate, the ink can be regulated to be ejected at a velocity substantially lower than the velocity of ejection of ink during the printing on the substrate. The ejection of the ink at low velocities allows the air blower to effectively blow the ink away towards the blower-spittoon, preventing the ink from being ejected onto the substrate. In another example, the ink can be regulated to eject ink droplets having substantially less weight than the ink droplets ejected during the printing operation.

The above aspects of the preset subject matter are further described in the figures and associated description below. It should be noted that the description and figures merely illustrate the principles of the present subject matter. Therefore, various arrangements that use the principles of the present subject matter, although not explicitly described or shown herein, can be devised from the description and are included within its scope.

FIG. 1 illustrates components of a printer 100, according to an example of the present subject matter. The printer 100 may include a printhead 102, a servicing mechanism 104 for servicing the printhead, and a control device 106 for regulating the servicing of the printhead 102. According to an aspect, the printhead 102 can include a plurality of ink nozzles 108 in fluid communication with one or more ink channels 110. The ink channels 110 can hold the ink and the ink nozzles 108 can form a passage for ejection of the ink onto a substrate. In an example, the printhead 102 can be a fixed-type printhead which is stationary with respect to the substrate, or a scanning-type printhead which is movable with respect to the substrate. Servicing of the printhead 102 can be an activity achieved for preventing drying of ink in the ink nozzles 108 or in the ink channels 110 or both. Accordingly, as part of servicing, the ink can be ejected from the ink nozzles 108 even when printing is not to be achieved to keep all the ink nozzles 108 in functional condition.

The present subject matter provides for servicing of the printhead 102 without incurring substantial downtime of the printer 100, for instance, incurred in ceasing feed of the substrate towards the printhead 102. Accordingly, the control device 106 regulates to continue the feed of the substrate towards the printhead during an idle period, i.e., the time during which the printhead is to be serviced. The idle period can be the duration during which the printing on the substrate is suspended. For example, in case the substrate is narrower in width than the printhead 102, the ink nozzles 108 outside the printing region of the substrate which are not involved in printing on the narrow substrate can also be considered as being idle during the idle period. The ink nozzles 108 within the printing region of the substrate and are involved in printing on the substrate can continue to operate and eject the ink during the idle period.

In addition, when the feed of the substrate is continuously provided, the control device 106 regulates the ejection of the ink from the ink nozzles 108 towards the substrate, and controls the operation of the servicing mechanism 104 to capture the ink ejected by the ink nozzles before the ink reaches the substrate. The components of the printer 100 and the servicing of the printhead 102 are discussed further in detail with reference to FIG. 2 and FIG. 3.

Figure 2:
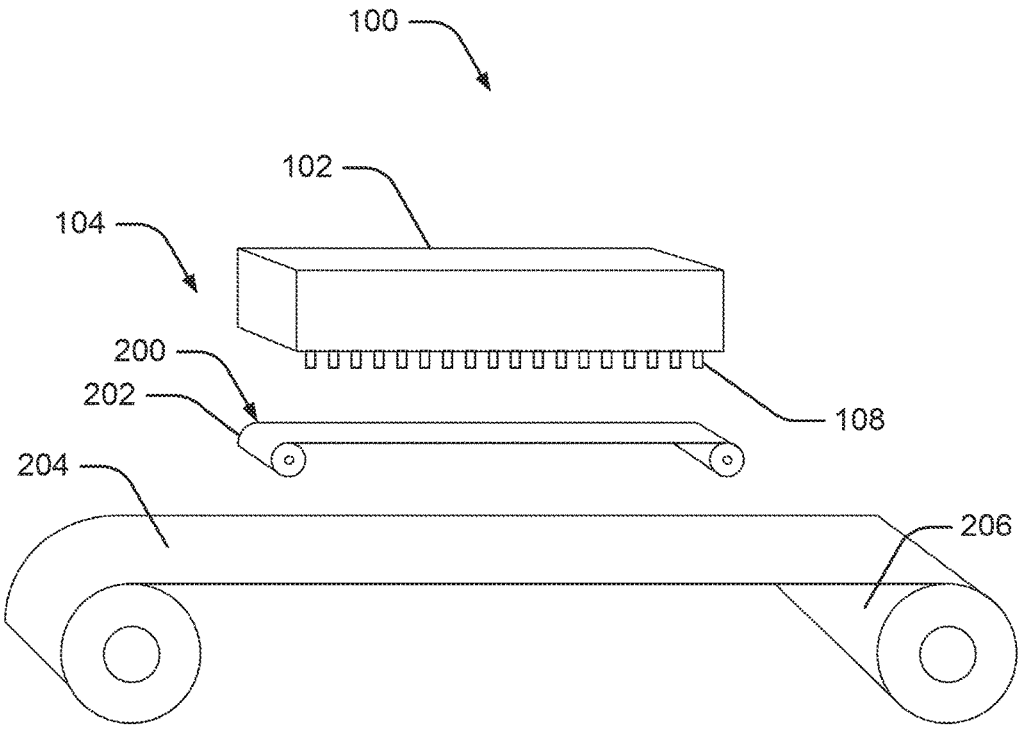
FIG. 2 illustrates a schematic of a servicing mechanism of the printer, according to an example of the present subject matter.

FIG. 2 illustrates a schematic of the servicing mechanism 104 of the printer 100, according to an example of the present subject matter. For instance, the servicing mechanism 104 includes an ink capturing unit 200 for capturing the ejected ink from the ink nozzles 108 during servicing of the printhead 102. In said example, the ink capturing unit 200 can include a spittoon 202 movable with respect to the printhead 102, between the printhead 102 and a substrate 204 fed across the printhead 102. For instance, the printer 100 can include a feeding mechanism 206 for passing the substrate 204 across the printhead 102. The feeding mechanism 206 can be coupled to the control device 106 for regulating the feeding mechanism 206 to control the feed of the substrate towards the printhead 102.

In an example, for effecting movement of the spittoon 202, the spittoon 202 can be coupled to an actuation mechanism (not shown), the actuation mechanism being further coupled to the control device 106 to regulate the motion of the spittoon 202. During operation, the control device 106 can determine the idle period of the printer 100, and can regulate the feeding mechanism 206, the printhead 102, and the spittoon 202 for servicing the printhead 102.

For example, during the idle period, the feeding mechanism 206 continues feeding the substrate 204 towards the printhead 102. In other words, the feeding mechanism 206 provides feed of the substrate 204 towards the printhead 102 when the printing on the substrate is not to be achieved. Further, an ejection mechanism (not shown) of the printhead 102 which achieves the ejection of the ink from the ink nozzles 108 is coupled to the control device 106 for regulating the ejection of the ink. For instance, the ejection mechanism can be a piezoelectric mechanism, a thermal mechanism, or a combination thereof.

During the idle period, when the feed of the substrate 204 is continuously provided towards the printhead 102, the control device 106 can regulate the ejection mechanism to control the ejection of the ink from the ink nozzles 108 towards the substrate 204. In an example, the ejection mechanism can eject the ink from the ink nozzles 108 towards the substrate 204 during the idle period at the same velocity as that when the printing operation is carried out.

Further, the actuation mechanism of the spittoon 202 can be operated to move the spittoon across the printhead 102 during the idle period, to capture the ink and prevent the ink ejected from the ink nozzles 108 to reach the substrate 204. In one case, the spittoon 202 can include an absorbent for capturing the ink. The provision of the absorbent allows the spittoon 202 to effectively capture the ink, and allows for long operational durations of the spittoon 202 since the absorbent can absorb large quantities of ink.

In said example, the idle period can correspond to a non-printable portion of the substrate 204. The non-printable portion, as the name suggests, refers to that portion of the substrate 204 on which printing is not to be achieved. For instance, in case of newspaper printing operation, two adjacent sheets to be printed can be separated by a non-printable margin, referred to as the non-printable portion. Accordingly, in said example, the spittoon 202 can be moved along the printhead 102 for servicing and capturing ink when the non-printable portion of the substrate 204 is passing across the printhead 102.

In another example, page margins and inter-line blank spaces on the substrate 204 can be used as the non-printable portions of the substrate 204 for servicing the printhead 102. In such a case, a cover, such as a thin metallic foil, can be provided over a part of the margin or on the inter-line blank spaces. Further, according to an aspect, in such a case, the cover over the substrate 204 may function as the spittoon and, for servicing, the ink can be ejected from the ink nozzles 108 when the cover is passing across the printhead 102. Accordingly, no unused space has to be provided, for example, as in the case of newspaper printing described above.

In an example, the spittoon 202 can be moved along a width of a nozzle plate (not shown) of the printhead 102. The nozzle plate can be the portion of the printhead 102 facing the substrate 204 and having the ink nozzles 108 provided thereon. In other words, the spittoon 202 can be movable along a short dimension of the printhead 102. In such a case, the spittoon 202 can move across the printhead 202 in considerably less time, and capture the ink during that time, i.e., during the idle period. Accordingly, the movement of the spittoon 202 across the printhead 102 can be conveniently coordinated with the passage of the non-printable portion of the substrate 204 across the printhead 102, in case the idle period corresponds to the passage of the non-printable portion of the substrate 204. In another example, the idle period can be a turnaround period of the printhead 102 at an end of swath. In such a case, in an example, the printhead 102 can be a scanning type printhead.

Figure 3:
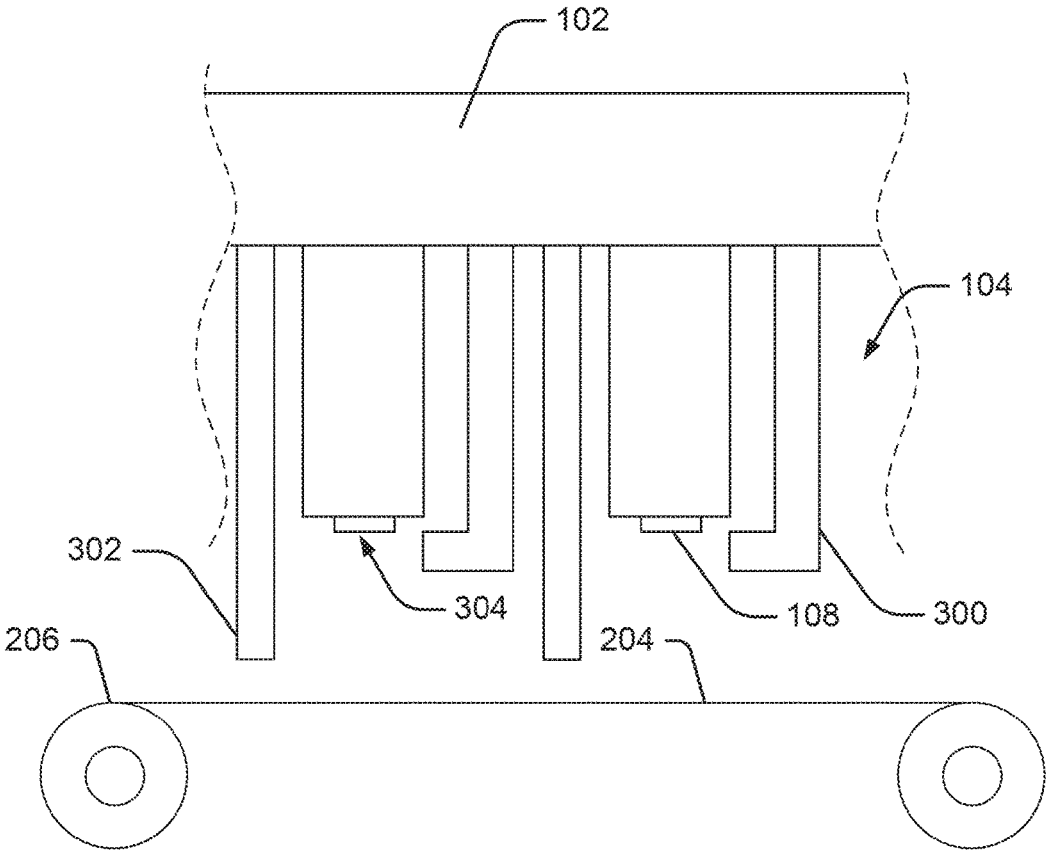
FIG. 3 illustrates a schematic of a servicing mechanism of the printer, according to another example of the present subject matter.

FIG. 3 illustrates a schematic of the servicing mechanism 104 of the printer 100, in accordance with another example of the present subject matter. In said example, the ink capturing unit 200 of the servicing mechanism 104 includes an air blower 300 and a blower-spittoon 302. The air blower 300 and the blower-spittoon 302 can be provided in the proximity of the ink nozzles 108. In an example, each ink nozzle 108 can be provided with one air blower 300 and one blower-spittoon 302. In another example, a set of ink nozzles 108 can be provided with one air blower 300 and one blower spittoon 302. Further, the air blower 300 can be coupled to the control device 106 for regulating the operation of the air blower 300 for servicing the printhead 102.

In operation, during the idle period, the air blower 300 is operated to blow the ink ejected away from an exit 304 of the ink nozzles 108 towards the blower spittoon 302 provided in the vicinity. Accordingly, the ink is captured by the blower-spittoon 302 and is prevented from reaching the substrate 204 for printing. In one case, the blower-spittoon 302 can include an absorbent (not shown) for capturing the ink. The provision of the absorbent can provide for effectively capturing the ink at the blower-spittoon 302, in the same manner as previously explained with reference to the spittoon 202.

The operation of the feed mechanism 206 and the ejection mechanism is controlled in the same manner as explained above. For instance, during the idle period, the feed mechanism 206 continues to feed the substrate 204 towards the printhead 102 and the ejection mechanism is controlled to regulate the ejection of the ink from the ink nozzles 108. In an example, the ejection mechanism can be regulated to eject the ink from the ink nozzles 108 at a velocity substantially lower than the velocity of ejection of the ink while printing. In another example, the ejection mechanism can be regulated to eject ink droplets having substantially less weight than the ink droplets ejected during printing operation on the substrate. In the above examples, the ejection of the ink droplets at such low velocities or having such substantially less weight allows the air blower 300 to effectively blow the ink towards the blower-spittoon 302.

Further, in such a case, in one example, the idle period can correspond to the passage of the non-print portion of the substrate 204 across the printhead 102. In another example, the idle period can be the turnaround period of the printhead 102 at the end of swath.

Figure 4:
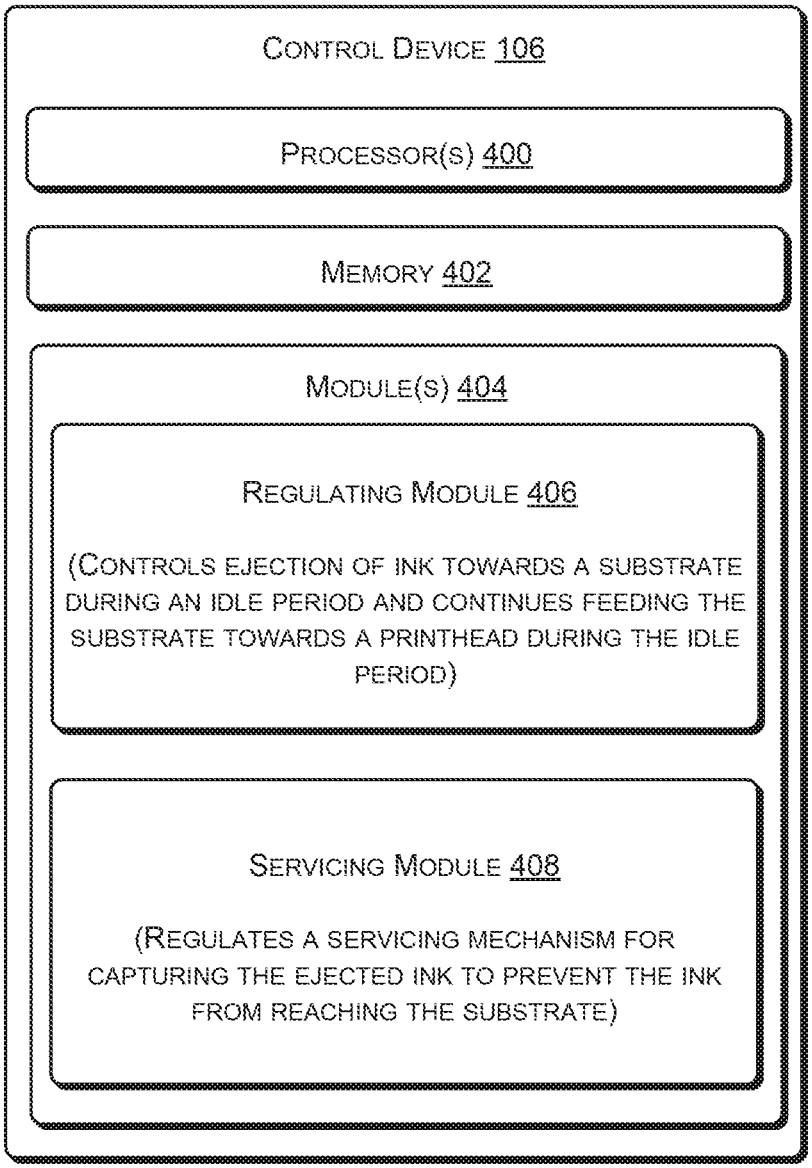
FIG. 4 illustrates a schematic of a control device of the printer, according to an example of the present subject matter.

FIG. 4 illustrates the control device 106 of the printer 100 for servicing the printhead 102. For instance, the control device 106 can regulate the operation of the ejection mechanism of the printhead 102, the feeding mechanism 206, and the servicing mechanism 104, for achieving maintenance of the printhead 102. The control device 106 can include, for example, a processor 400, a memory 402, and modules 404 communicatively coupled to the processor 400. The processor 400, among other capabilities, may fetch and execute computer-readable instructions stored in the memory 402. The memory 402, communicatively coupled to the processor 400, can include a non-transitory computer-readable medium including, for example, volatile memory, such as Static Random Access Memory (SRAM) and Dynamic Random Access Memory (DRAM), and/or non-volatile memory, such as Read Only Memory (ROM), erasable programmable ROM, flash memories, hard disks, optical disks, and magnetic tapes.

The processor 400 may include microprocessors, microcomputers, microcontrollers, digital signal processors, central processing units, state machines, logic circuitries, and/or any other devices that manipulate signals and data based on computer-readable instructions. Further, functions of the various elements shown in the figures, including any functional blocks labeled as "processor(s)", may be provided through the use of dedicated hardware as well as hardware capable of executing computer-readable instructions. In one example of the present subject matter, the control device 106 can be the processor. In such a case, the control device 106 can be one of the above mentioned components. In addition, the memory 402 and the modules 404 can be directly coupled to the control device 106, i.e., the processor, for operation.

The modules 404, amongst other things, include routines, programs, objects, components, and data structures, which perform particular tasks or employ particular abstract data types. The modules 404 may also be deployed as, signal processor(s), state machine(s), logic circuitries, and/or any other device or component that manipulates signals based on operational instructions. Further, the modules 404 can be deployed by hardware, by computer-readable instructions executed by a processing unit, or by a combination thereof. The modules 404 can include a regulating module 406 and a servicing module 408. The modules 404 may include computer-readable instructions that supplement applications or functions performed by the control device 106.

During operation, the regulating module 406 ascertains the idle period for the printhead 102 during which the servicing of the printhead 102 is to be achieved. As mentioned previously, the idle period can correspond to the passage of the non-print portion of the substrate 204 across the printhead 102 or can be the turnaround period of the printhead 102 at the end of swath. For instance, the regulating module 406 can determine the idle period based on various parameters, such as layout of prints, layout of the substrate 204, printing margins of the substrate 204, and type of printer 100. In one example, the idle period can be predefined and stored in the memory 402 of the control device 106 and can be accessed by the regulating module 406 for operation. In another example, the regulating module 406 can request a user of the printer 100, during operation, to provide the idle period for servicing the printhead 102.

Further, the regulating module 406 can control the ejection mechanism of the printhead 102 to control the ejection of ink form the ink nozzles 108 during the idle period. For instance, in one case, when the servicing mechanism 104 includes the spittoon 202, the regulating module 406 can control the ejection mechanism to eject the ink at the same velocity as the ink is ejected during the printing operation. In another case, when the servicing mechanism 104 includes the air blower 300 and the blower-spittoon 302, the regulating module 406 can regulate the ejection mechanism to eject the ink at a velocity substantially less than that at which the ink is ejected during printing. Accordingly, in the latter case, the regulating module 406 achieves trickling of the ink from the ink nozzles 108 for the servicing mechanism 104 to be able to effectively blow and capture the ejected ink. In another example, the regulating module 406 can regulate the ejection mechanism to eject ink droplets having substantially less weight than the ink droplets ejected during printing operation.

Further, at the same time that the ejection of ink is regulated, i.e., during the idle period, the regulating module 406 can control the feeding mechanism 206 to continuously feed the substrate 204 towards the printhead 102. In other words, in one example, the feed of the substrate 204 towards the printhead 102 can remain unaffected during the idle period.

In addition, when such controls are being exercised by the regulating module 406, the servicing module 408 regulates the servicing mechanism 104 to service the printhead 102. In an example, in case the servicing mechanism 104 includes the spittoon 202, the servicing module 408 can regulate the movement of the spittoon 202 across the printhead 102. For instance, the servicing module 408 can control the actuation mechanism coupled to the spittoon 202 to control the movement of the spittoon 202. In an example, the servicing module 408 can regulate the movement of the spittoon 202 to complete the movement of the spittoon 202 from one end of the printhead 102 to another within the idle period.

In another example, in case the servicing mechanism 104 includes the air blower 300 and the blower-spittoon 302, the servicing module 408 regulates the operation of the air blower 300 to blow the ink towards the blower-spittoon 302 to capture the ink before the ink reaches the substrate 204.

Figure 5:
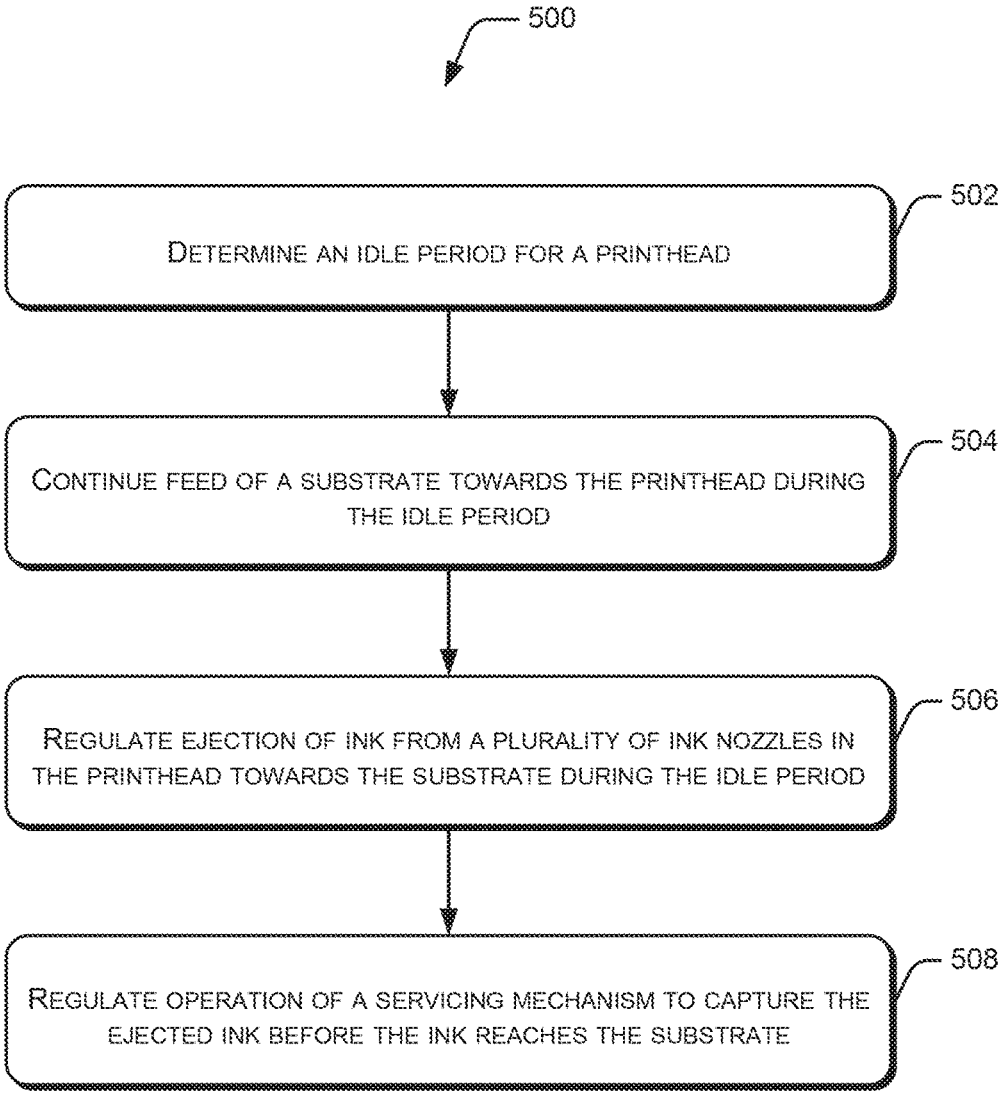
FIG. 5 illustrates a method for servicing the printer, according to an example of the present subject matter.

Method 500 is described in FIG. 5 for servicing the printhead 102 of the printer 100, according to an example of the present subject matter. The order in which the method 500 is described is not intended to be construed as a limitation, and any number of the described method blocks can be combined in any appropriate order to carry out the method 500 or an alternative method. Additionally, individual blocks may be deleted from the method 500 without departing from the spirit and scope of the subject matter described herein.

The method 500 can be performed by programmed computing devices, for example, based on instructions retrieved from non-transitory computer readable media. The computer readable media can include machine-executable or computer-executable instructions to perform all or portions of the described method. The computer readable media may be, for example, digital memories, magnetic storage media, such as a magnetic disks and magnetic tapes, hard drives, or optically readable data storage media.

Referring to FIG. 5, the method 500 may be performed by a control device, such as the control device 106 associated the printer 100.

At block 502, an idle period for the printhead 102 can be determined during which the servicing of the printhead 102 is to be achieved. As mentioned previously, the idle period can correspond to the passage of a non-print portion of the substrate 204 across the printhead 102 or can be the turn-around period of the printhead 102 at the end of swath. Further, the idle period can be previously stored or can be requested from the user of the printer 100 when the servicing is to be carried out.

At block 504, a feed of the substrate 204 towards the printhead 102 is continued during the idle period. In other words, the feed of the substrate 204 towards the printhead can remain unaffected in the idle period, and the feed can be provided in the same manner as during the printing operation of the printer 100. In an example, the feeding mechanism 206 of the printer 100 can be in continuous operation while the printhead 102 is being serviced.

At block 506, ejection of ink from the plurality of ink nozzles 108 of the printhead 102 is regulated during the idle period. For example, in one case, when the servicing mechanism 104 includes the spittoon 202, the ejection of the ink can be achieved at the same velocity as that during the printing operation. In another case, when the servicing mechanism 104 includes the air blower 300 and the blower-spittoon 302, the ejection of the ink can be achieved at a velocity substantially less than that at which the ink is ejected during printing. Further, in latter case, the ejection can be regulated to eject ink droplets having substantially less weight than the ink droplets ejected during printing operation.

At block 508, the operation of the servicing mechanism 104 is regulated to capture the ejected ink before the ink reaches the substrate 204. In an example, in case the servicing mechanism 104 includes the spittoon 202, the movement of the spittoon 202 across the printhead 102 can be regulated. In said example, the movement of the spittoon 202 can be regulated to complete the movement of the spittoon 202 from one end of the printhead 102 to another within the idle period. In another example, in case the servicing mechanism 104 includes the air blower 300 and the blower-spittoon 302, the operation of the air blower 300 is regulated to blow the ink towards the blower-spittoon 302 to capture the ink.

Although aspect for servicing the printhead 102 of the printer 100 have been described in language specific to structural features and/or methods, it is to be understood that the appended claims are not necessarily limited to the specific features or methods described. Rather, the specific features and methods are disclosed as examples for servicing the printhead 102.

We claim:

1. A printer comprising:

a printhead having a plurality of ink nozzles for ejecting ink;

a servicing mechanism for capturing the ejected ink from the plurality of ink nozzles, to service the printhead; and a control device, coupled to the printhead and the servicing mechanism, to, continue feeding a substrate towards the printhead during an idle period, wherein the idle period of the printhead is a duration when printing on the substrate is suspended;

regulate ejection of ink from the plurality of ink nozzles towards the substrate during the idle period; and operate the servicing mechanism during the idle period, wherein the servicing mechanism is to capture the ink before the ink reaches the substrate.

2. The printer as claimed in claim 1, wherein the servicing mechanism comprises a spittoon for capturing the ink, the spittoon being movable with respect to the printhead, between the printhead and the substrate.

3. The printer as claimed in claim 2, wherein the spittoon is movable along a width of a nozzle plate of the printhead, the nozzle plate having the plurality of ink nozzles provided thereon.

4. The printer as claimed in claim 2, wherein the spittoon comprises an absorbent for capturing the ink.

5. The printer as claimed in claim 1, wherein the servicing mechanism comprises:

a blower-spittoon provided in proximity of at least one ink nozzle from among the plurality of ink nozzles; and an air blower provided in proximity of the at least one ink nozzle to blow the ejected ink towards the blower-spittoon.

6. The printer as claimed in claim 5, wherein the control device is to regulate ejection of the ink from the ink nozzles at a velocity substantially lower than a velocity of ejection of ink during the printing on the substrate.

7. The printer as claimed in claim 5, wherein the control device is to regulate ejection of ink droplets from the ink nozzles ejection mechanism is regulated to eject ink droplets having substantially less weight than ink droplets ejected during the printing on the substrate.

8. A control device for regulating servicing of a printhead of a printer, the control device comprising:

a regulating module to control ejection of ink from a plurality of ink nozzles of the printhead towards a substrate during an idle period, the idle period of the printhead being a duration when printing on the substrate is stopped, wherein the regulating module is to continue feeding the substrate towards the printhead during the idle period; and a servicing module to regulate a servicing mechanism of the printer for servicing the printhead during the idle period, wherein the servicing mechanism is to capture the ejected ink to prevent the ink from reaching the substrate.

9. The control device as claimed in claim 8, wherein the servicing module is to regulate movement of a spittoon of the servicing mechanism between the printhead and the substrate to capture the ink ejected from the ink nozzles during the idle period.

10. The control device as claimed in claim 9, wherein the idle period corresponds to a non-printable portion of the substrate, when the substrate is fed towards the printhead.

11. The control device as claimed in claim 8, wherein the servicing module is to regulate an air blower provided in proximity of at least one ink nozzle from among the plurality of ink nozzles to blow the ejected ink towards a blower-spittoon provided in proximity of the at least one ink nozzle.

12. The control device as claimed in claim 11, wherein the idle period is a turnaround period of the printhead at an end of swath.

13. A method for servicing a printhead of a printer, the method comprising:

determining an idle period for the printhead, wherein the idle period of the printhead is a duration when printing on a substrate is suspended;

continuing feed of the substrate towards the printhead during the idle period;

ejecting ink from a plurality of ink nozzles of the printhead towards the substrate during the idle period; and regulating operation of a servicing mechanism of the printer for servicing the printhead during the idle period, wherein the servicing mechanism captures the ejected ink before the ejected ink reaches the substrate.

14. The method as claimed in claim 13, wherein the regulating comprises one of:

controlling movement of the servicing mechanism between the printhead and the substrate to capture the ink ejected from the ink nozzles during the idle period; and controlling the servicing mechanism provided in proximity of at least one ink nozzle from among the plurality of ink nozzles to blow the ejected ink towards a blower-spittoon of the servicing mechanism provided in proximity of the at least one ink nozzle.

15. The method as claimed in claim 13, wherein the idle period is one of a turnaround period of the printhead at an end of swath and a period corresponding to a non-printable portion of the substrate when the substrate is fed towards the printhead.

* * * * *